United States Patent [19]

Dunn

[11] Patent Number: 4,730,938

[45] Date of Patent: Mar. 15, 1988

[54] MIXER HOUSING

[75] Inventor: Lyman D. Dunn, Chicago, Ill.

[73] Assignee: Zantek, Inc., Chicago, Ill.

[21] Appl. No.: 854,549

[22] Filed: Apr. 21, 1986

[51] Int. Cl.[4] ..... B01F 7/22

[52] U.S. Cl. ..... 366/282; 366/247; 366/281

[58] Field of Search ..... 366/281, 282, 283, 284, 366/331, 241, 242, 244, 245, 247, 249, 251, 183, 279; 206/501, 509; 220/355, 74; 248/455, 456; D7/312-316, 376-380; 221/203

[56] References Cited

U.S. PATENT DOCUMENTS

| | | | |
|---|---|---|---|
| 386,575 | 7/1888 | Cornelius | 366/245 |
| 797,959 | 8/1905 | Hulvorsen et al. | 366/281 |
| 1,138,815 | 5/1915 | Voss | 366/245 |
| 1,270,609 | 6/1918 | Ezra | 248/456 |
| 2,745,644 | 5/1956 | Von Behren | 366/282 |
| 3,158,360 | 11/1964 | Dunn | 366/282 |
| 3,223,389 | 12/1965 | Simmonds | 366/282 |

FOREIGN PATENT DOCUMENTS

| | | | |
|---|---|---|---|
| 770461 | 9/1934 | France | 366/284 |
| 253423 | 3/1948 | Switzerland | 366/281 |
| 17649 | 8/1904 | United Kingdom | 220/355 |

*Primary Examiner*—Harvey C. Hornsby
*Assistant Examiner*—Joseph S. Machuga
*Attorney, Agent, or Firm*—Mann, McWilliams, Zummer & Sweeney

[57] ABSTRACT

A mixer housing is provided to partially enclose and support a long shaft rotary mixer for use on an open cannister. The housing includes a generally semicircular seat channel on the housing's bottom panel configured to accommodate a range of cannister mouth diameters. The seat channel also includes raised bosses to cant the mixer shaft and its blade toward the center of the cannister and away from the cannister walls. Also included in a recessed bevelled sideboard on the housing which provides access to the cannister opening for ease in introducing ingredients into the cannister.

3 Claims, 4 Drawing Figures

MIXER HOUSING

BACKGROUND OF THE INVENTION

1. Field of the Invention

This invention relates to the class of apparatus used for mixing of liquid and liquifiable food ingredients and the like. Specifically, the field of this invention includes mixer arrangements which are mounted on the tops of open cannisters.

2. Description of the Prior Art

The following United States patents are considered relevant prior art by the applicant in the field of liquid mixer housings.

U.S. Pat. No. 2,736,535 to Clark et al. illustrates a mixing device including a bracket adapted to be mounted on the top of a paint can or the like. The mixer uses a journalled transmission to impart eccentric carriage to the mixers and rotating blades.

U.S. Pat. No. 2,745,644, to Von Behren, illustrates a portable mixer bowl support featuring pairs of grooves on a portable mixer base, each pair providing two points of a four point support, with the remaining supports being the lower ends of the mixer's beater shafts which rests on the bottom of the bowl.

U.S. Pat. No. 3,011,768 to F. Clark discloses a stirring device designed to sit eccentrically on a kitchen sauce pan or the like. The device's housing includes horizontal arms having serrations to accommodate a variety of container rim diameters.

U.S. Pat. No. 3,158,360 to the applicant discloses a mixer housing having a bottom panel with two rows of depending teeth to grip the periphery of a container mouth. It also shows a side board formed in the mixer housing for loading ingredients into the container.

U.S. Pat. No. 3,223,389 to Simmonds discloses a paint mixer designed to be clamped to the rim of a container, and, as thus mounted, to be disposed at an acute angle to the vertical.

U.S. Pat. No. 3,297,309 to Adams discloses a mixing apparatus having a vertical shaft and designed to be mounted to the rim of a container eccentrically so that a large recess is provided in the clamp plate for introduction of ingredients into the container for mixing.

None of the above listed prior art mixing devices teaches the use of a contoured bottom channel to accommodate various rim sizes in combination with bosses formed at the base of the channel to angle the mixing shaft toward the center of the container.

SUMMARY OF THE INVENTION

The present invention provides a mixer housing for use with a food product container or cannister having a substantially vertical mouth to mix liquid and liquifiable ingredients, including what is commonly known as soft serve ice cream. The mixer housing, which holds a mixer motor and controls and a vertically dependent mixer shaft, is of unitary construction with a removable back plate for access to the motor. The housing includes a base with a substantially semicircular seat channel to accommodate container mouth rims of varying sizes. Bosses are provided near the ends of the seat channel so that the mixer sits on the container's rim at an angle to allow the mixer blades to rotate near the center of the container's bottom, away from the container side.

A chamfered side board is provided on the mixer housing to facilitate the introduction of ingredients into the container when the mixer is in place.

DESCRIPTION OF THE DRAWING FIGURES

DETAILED DESCRIPTION OF THE PREFERRED EMBODIMENT

Figure 1:
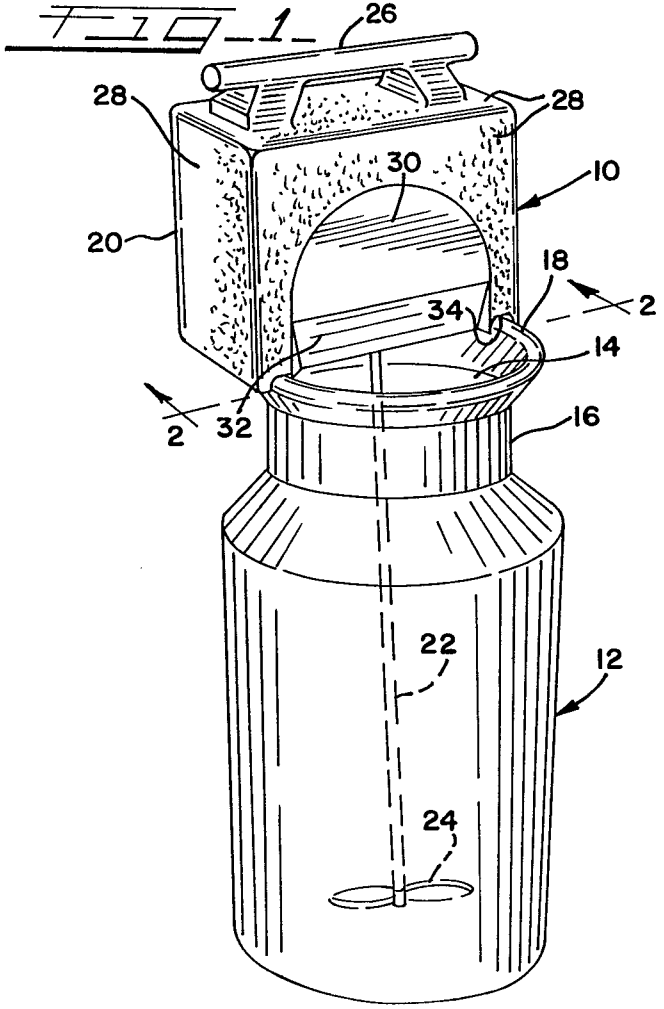
FIG. 1 is a general perspective view of the mixer housing embodying applicant's invention in place on a mixing container.

In FIG. 1 of the drawings is shown the mixer housing 10 seated on container or cannister 12. Container 12 has a substantially vertical mouth 14 and constricted throat 16. Mixer housing 10 is of generally quadrilateral external configuration, and is positioned on rim 18 of container or cannister 12. As shown in FIG. 1, mixer housing 10 is of substantially unitary construction with a rear access panel 20 (not shown) to provide, at the housing rearwall, access to the mixer motor and controls within housing 10. Depending from housing 10 through its bottom wall is mixer shaft 22, which is shown in FIG. 1 substantially in phantom within container 12. Attached to the end of shaft 22 are mixing blades 24 to which rotational force is transferred to mix food ingredients.

Formed integrally with the top wall of housing 10 is mixer handle 26. Mixer housing 10 has a textured surface on its faces 28 with the exception of its front wall side board 30 that merges into inwardly chamfered side board 32. Mixer housing 10 is seated on the rim 18 of container 12 with the seat channel 34 of its bottom wall mated to rim 18.

Figure 2:
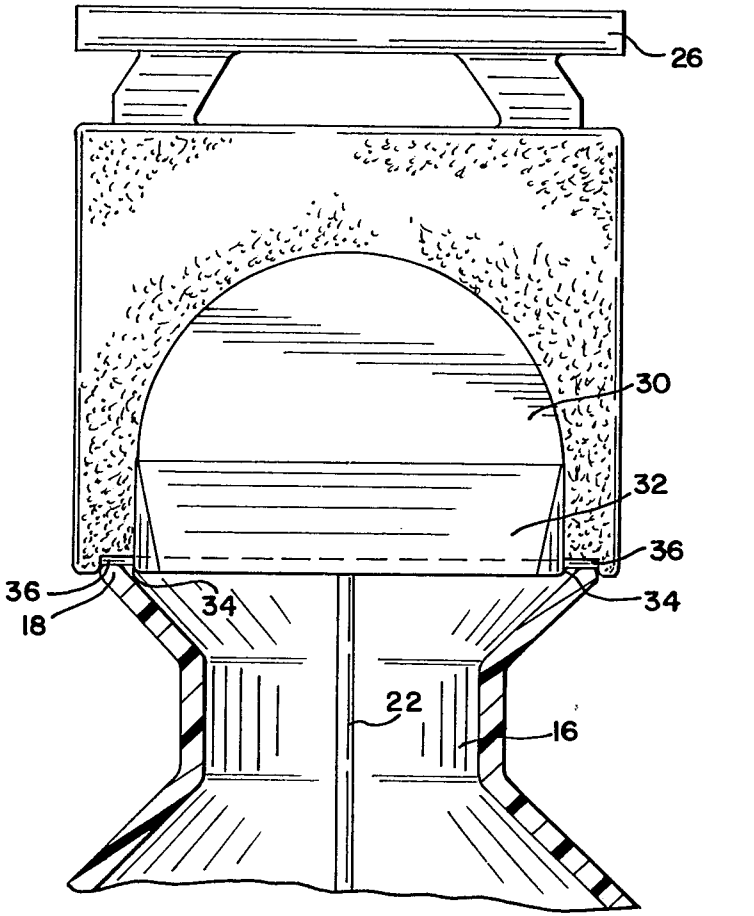
FIG. 2 is a front elevational view of the mixer housing taken along the line 2—2 of FIG. 1.
Figure 4:
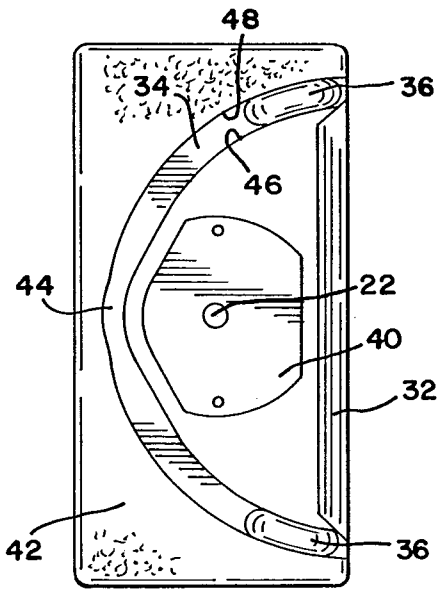
FIG. 4 is a bottom plan view of the mixer housing embodying the present invention.
Figure 3:
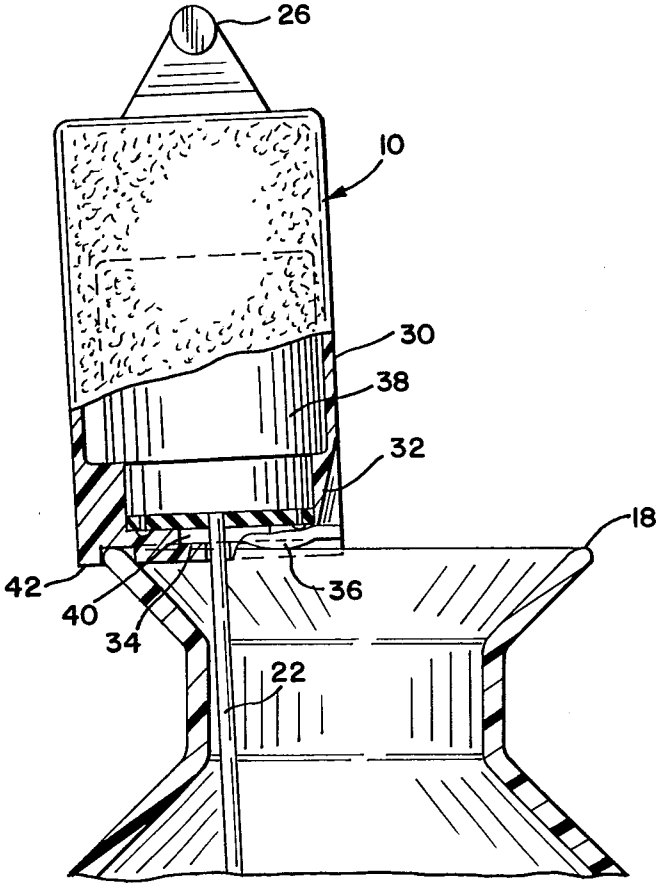
FIG. 3 is a side elevational view of the mixer housing previously shown, with the mixer shown partially broken away.

As shown in FIGS. 2–4 depending or downwardly directed bosses 36 are provided in seat channel 34. The location of bosses 36 is more clearly illustrated in FIGS. 3 and 4; thus, the respective bosses 36 are formed in the floor of channel 34 adjacent the ends thereof, near the juncture of the housing front wall chamfered side board 32 and bottom wall or base 42 where the respective seat channel ends are open at the front of the mixter housing 10 (see FIGS. 1 and 4).

In FIG. 3, a side view of the mixer housing 1 illustrates the placement of mixer motor 38 on motor mounting plate 40 in the housing bottom wall or base 42. Mixer shaft 22 passes through mounting plate 40 and the housing bottom wall to transmit rotational energy from mixer motor 38 to mixer blades 24.

The bosses 36 formed on the floor of the housing bottom wall channel 34 rest on the top of the container rim 18 to tilt mixer housing 10 to the left in the showing of FIG. 3. Mixer housing 10 as positioned on the container rim 18 in accordance with the present invention rests on rim 18 at three points, namely, at the two bosses 36 and the floor of center portion 44 of channel 34. With this orientation, mixer shaft 22 and blades 24 are tilted toward the center of container or cannister 12, and away from the container side wall, to provide for more thorough mixing of ingredients.

Channel 34 is designed to accommodate a range of container or cannister rim diameters. The radius of inner or from wall 46 of channel 34 (see FIG. 4) is smaller than the radius of outer or rear wall 48. Channel 34 is narrowed at midpoint 44 to grip the container rim 18 to prevent undue slippage of the mixer on the cannister. Smaller rim diameters are accommodated by inner wall 46 of channel 34 and larger rim diameters are accommodated by outer wall 48.

Side board 30 and inwardly chamfered or beveled side board 32 are provided at the front of housing 10 to provide a larger opening at the front of housing 10 for the introduction of ingredients into the cannister. Both these portions of the housing front wall are relatively free of surface texture, and thus are smooth (as indicated by FIGS. 1 and 3) to facilitate the flow of powdered and granulated ingredients.

Various features of the invention have been particularly shown and described in connection with the illustrated embodiments of the invention. However, it must be understood that these particular arrangements merely illustrate and that the invention is to be given its fullest interpretation within the terms of the appended claims.

What is claimed is:

1. For a food mixing container having an open mouth adjacent the top of same and a side wall defining a lower food ingredient receiving container portion below the container mouth, above which container mouth is disposed an upstanding rim that is centered on the container mouth and is in circumambient relation to the container mouth, with the container sidewall and rim being concentric about a common axial center that forms the axial center of the container and extends heightwise of the container, a mixer therefor adapted to seat on the mixing container rim for performing mixing operations on food ingredients when the food ingredients received in the mixing container lower portion, said mixer comprising:

a generally quadrilateral housing having a top wall, a bottom wall, a front wall, a rear wall, and a pair of opposed side walls extending between said rear wall and said front wall on either side of said housing, handle means connected to said housing for manual grasping of said housing to apply same to the container rim and lift same therefrom, mixing means dependent from said housing in substantial perpendicular relation to and through said bottom wall and including an elongate rectilinear shaft substantially centered on said housing and having a depending end equipped with blade means adjacent said shaft depending end for reception in and mixing the food ingredients when the food ingredients are received in the mixing container lower portion and said mixer is seated on the mixing container rim, means mounted in said housing for driving said shaft and mixer blade means in mixing relation to the food ingredients when the food ingredients are received in the mixing container lower portion and said mixer is seated on the mixing container rim, said housing bottom wall defining a generally semicircular downwardly opening channel for seating said housing on the container rim with said mixer housing mixing means disposed within the container lower portion, and with said mixer being free of engagement with the container side wall, said bottom wall channel having a floor and end portions disposed adjacent to, and open at, the lower portion of said housing front wall and the front of said mixer housing, said bottom wall channel defining a midlength portion that is intermediate of said channel end portions lengthwise of said channel and is disposed between said shaft and said housing rear wall, said channel further defining in said floor thereof, adjacent each of said channel end portions and within said channel, a downwardly directed boss, with said bosses similarly depending below said channel floor, whereby, when said mixer is seated in upright relation to the container rim with the container rim received within said mixer housing bottom wall channel, with said shaft and blade means of said mixing means disposed within the container, and said mixer resting on said channel midlength portion and said bosses, said bosses tilt said mixer so that said mixer shaft is disposed away from the container side wall and toward the container axial center.

2. The mixer set forth in claim 1 wherein:

said channel comprises a front wall and a rear wall formed in said housing bottom wall, with said channel front and rear walls being spaced apart at said midportion of said channel to grip the container rim on which said housing is seated, with said channel front and rear walls, to either side of said channel midportion, and to the respective channel ends, being spaced apart to accommodate container rims of various diameters.

3. The mixer set forth in claim 1 wherein:

said mixer housing front wall includes a centrally located side board portion, that merges into, adjacent the bottom of said mixer housing, a chamfered smooth portion that is beveled inward of said housing downwardly thereof, for facilitating the introduction of food ingredients, to be mixed, into the container, with said mixer seated on the container rim in said upright relation.

* * * * *